United States Patent [19]

East

[11] 4,095,828

[45] Jun. 20, 1978

[54] LOCKING ASSEMBLY

[76] Inventor: Eldon Dwayne East, 4522 Casa Oro Dr., Yorba Linda, Calif. 92686

[21] Appl. No.: 768,079

[22] Filed: Feb. 14, 1977

[51] Int. Cl.[2] ..... E05C 1/04; E05C 13/02

[52] U.S. Cl. ..... 292/148; 70/54; 70/417; 70/DIG. 57

[58] Field of Search ..... 292/145, 146, 147, 148, 292/149, 150, 151, 152, 154, 205, 281, 283; 70/54, 55, 56, 129, 417, DIG. 57

[56] References Cited

U.S. PATENT DOCUMENTS

| | | | |
|---|---|---|---|
| 295,464 | 3/1884 | Topham | 292/147 |
| 611,941 | 10/1898 | Robertson | 292/150 |
| 838,644 | 12/1906 | Rapson | 292/145 |
| 1,317,092 | 9/1919 | Maurer et al. | 292/148 |
| 1,368,711 | 2/1921 | Foley | 292/148 |
| 2,482,341 | 9/1949 | Holmsten | 292/148 |
| 2,613,970 | 10/1952 | Holmsten | 292/148 |
| 2,701,734 | 2/1955 | Grossman | 292/147 |
| 3,334,933 | 8/1967 | Ehcers | 292/148 |
| 3,451,703 | 6/1969 | Roegner | 292/148 |
| 3,572,796 | 5/1971 | Willner | 292/281 |
| 3,599,453 | 8/1971 | Bauernfeind | 292/148 X |

FOREIGN PATENT DOCUMENTS

| | | | |
|---|---|---|---|
| 853,639 | 12/1939 | France | 292/148 |
| 425,811 | 4/1911 | France | 292/145 |
| 548,971 | 11/1922 | France | 292/147 |
| 318,457 | 3/1919 | Germany | 292/148 |
| 483,973 | 5/1953 | Italy | 292/145 |
| 803,276 | 10/1958 | United Kingdom | 292/148 |

*Primary Examiner*—Roy D. Frazier
*Assistant Examiner*—Thomas J. Holko
*Attorney, Agent, or Firm*—Edward E. Roberts

[57] ABSTRACT

A locking assembly incorporating a padlock wherein the shackle of the padlock is housed within a rigid protective enclosure when the assembly is locked. The locking assembly includes barrel and bolt members which engage the components to be locked and which members include apertures therein which are located adjacent to each other such that the shackle of the padlock can pass therethrough. The protective enclosure or barrel has an elongated, "double-S" configuration with a central portion thereof forming a barrel-like member. The shackle of the lock passes through the apertures in the barrel and bolt members whereby the lock engages and retains the bolt member while the shackle of the lock is substantially surrounded by the barrel member.

7 Claims, 4 Drawing Figures

LOCKING ASSEMBLY

BACKGROUND

1. Field of the Invention

This invention relates to a locking assembly which utilizes a conventional padlock as an important component thereof but which is so constructed that tampering with the padlock is precluded.

2. Prior Art

Conventional or known padlocks exist in the art. The conventional or known padlocks have been developed through the years so as to exhibit greater strength and reliability. For example, conventional padlocks have been strenghtened by the addition of features such as laminated body construction, hardened exterior components, various internal improvements and the like. However, despite these improvements, unauthorized access to the locked area has been accomplished by the application of excessive tensile force between the shackle and the padlock body wherein a portion of the lock is broken. In addition, the shackle is also vulnerable to attack such as by cutting, sawing or the like.

Many approaches to these problems are known in the art. Various techniques and/or devices have been utilized to overcome these shortcomings in typical or conventional padlocks to prevent the breakage thereof. The most pertinent art known to applicant is shown and described in the following U.S. Pat. No.: 2,707,646, Hazy; 2,781,215 Griffith; 3,334,933, Erlers; 3,451,703, Roegner; 3,599,453, Bauernfeind; and 3,655,229, Tumbiolo.

SUMMARY OF THE INVENTION

The invention is directed to a locking assembly of the bolt and barrel type. The barrel is essentially formed by an unitary member which includes a barrel portion through which the bolt may slide. The bolt includes a solid portion for effecting dead-bolt type operation and a further portion which is utilized for engagement with the padlock. The padlock shackle is passed through the barrel portion in engagement with the bolt portion to selectively prevent movement of the bolt. The barrel portion also engages and protects the shackle portion of the padlock to prevent unauthorized access thereto.

BRIEF DESCRIPTION OF THE DRAWING

In each of the Figures similar components bear similar reference numerals.

DESCRIPTION OF A PREFERRED EMBODIMENT

Figure 1:
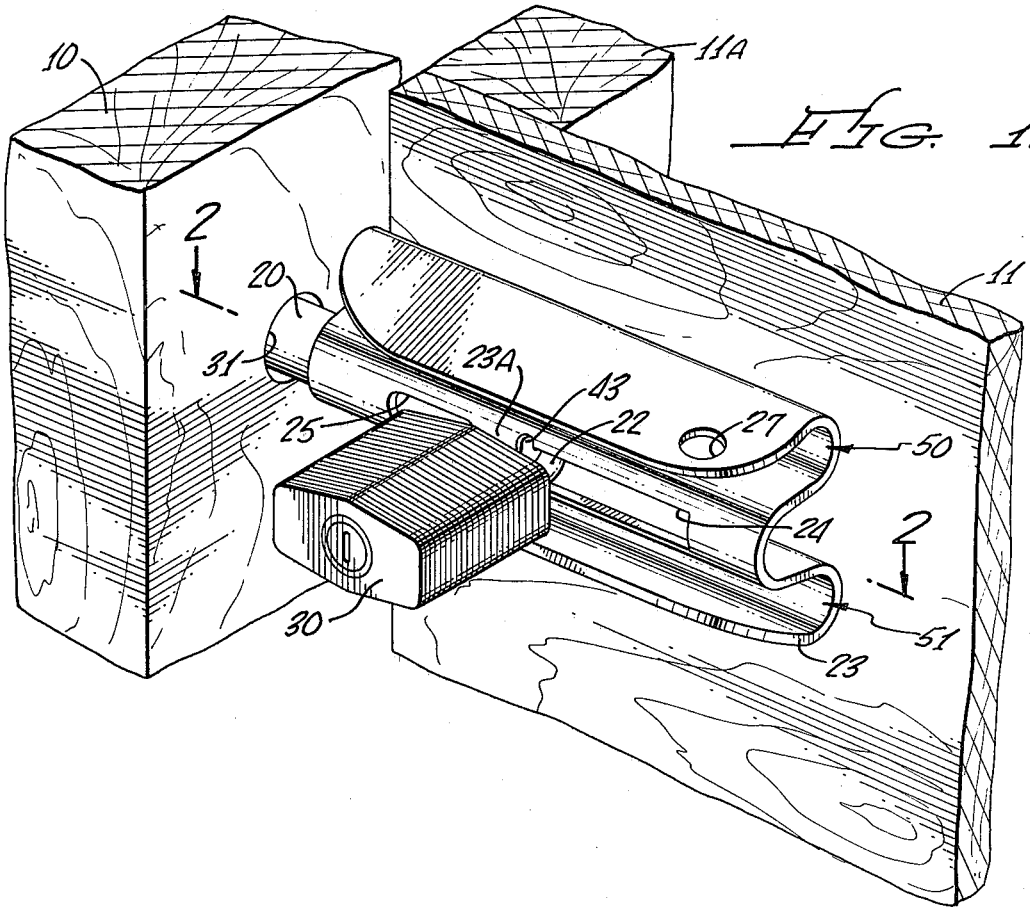
FIG. 1 is a perspective view of the locking assembly engaged with the components to be locked.

Referring now to FIG. 1 there is shown a perspective view of the locking assembly of the instant invention in an assembled, locking arrangement. Initially, it is assumed that a basis reference structure such as a door frame 10 is provided. In addition, door 11 which is movable relative to frame 10 is also provided. A support member 11A associated with door 11 is illustrated. It should be understood that while frame 10 and door 11 are suggested, the roles may be reversed and element 11 may be the frame while element 10 may be the door. The relative motion (and position) of the devices or elements 10 and 11 is dependent upon the preferred application of the locking assembly.

The locking assembly includes bolt portion 20 which is slidably inserted into aperture 31 in frame 10. In addition, the locking assembly includes the barrel portion which is shown generally at 23. The barrel portion includes a unitary member which has a "double-S" configuration. That is, the barrel is basically formed of a central, rolled portion of a suitable blank.

The central barrel portion is appropriately sized to contain bolt 20 in slidable relationship. The outer ends of the blank from which barrel member 23 is formed are reversed upon themselves by approximately 180 degrees or more. This reversal forms the double-S configuration and thereby forms grooves 50 and 51 between the outer edges of the blank and the central barrel portion of barrel member 23. An aperture 27 may be included in one of the edge portions of barrel member 23 as a convenience member for storing lock 30 when not in use.

The outer surface of barrel member 23 includes apertures 24 and 25 which are relatively elongated openings in the outer periphery of the central barrel portion of barrel member 23.

As described subsequently, bolt 20 includes end portion 43 at the barrel end thereof which engages barrel member 23. End portion 43 extends through opening 24 in barrel member 23. End portion 43 includes "ears" or the like to retain this end of bolt 20 in barrel 23 when assembled. In addition end member 43 may be utilized to grasp bolt 20 to move the bolt from or to the locking position as desired.

Padlock 30 includes shackle 22. Shackle 22 passes through aperture 24, around end portion 43 and back through aperture 25 and barrel member 23. When padlock 30 is engaged, shackle 22 maintains bolt 20 in the locked position. In addition, the folded portions of barrel member 23 extend beyond the central portion thereof and effectively cover shackle 22 of padlock 30. Thus, access to the shackle, in the locked position, is extremely difficult.

Figure 2:
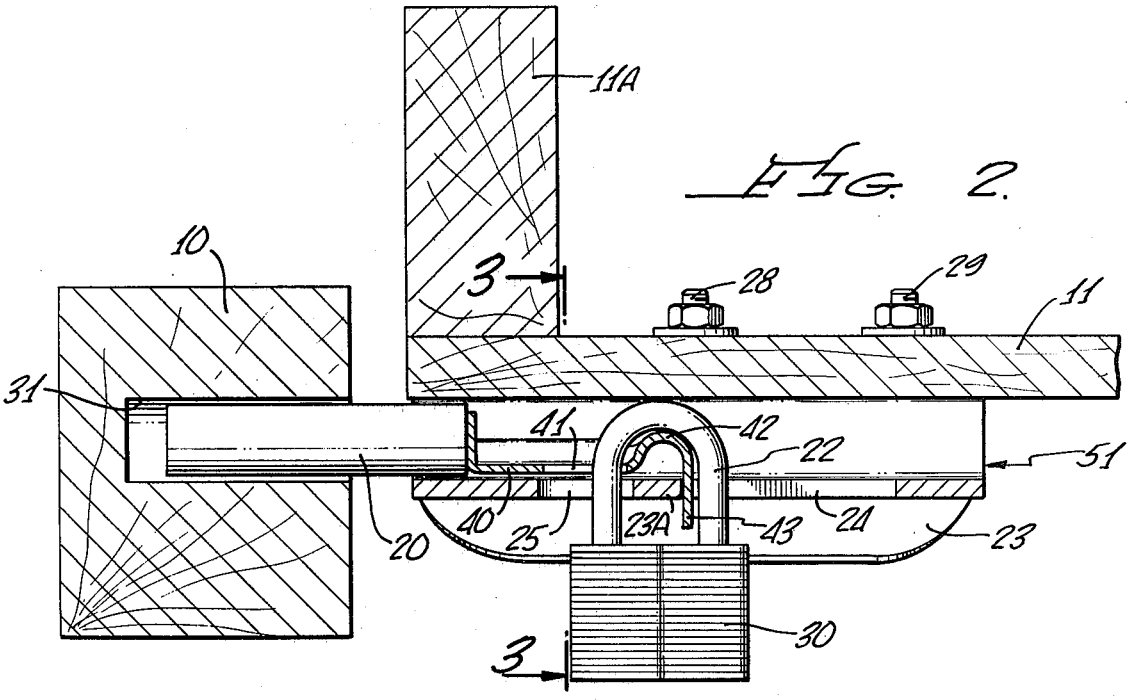
FIG. 2 is a cross-sectional view of the locking assembly taken along the lines 2—2 of FIG. 1.

Referring now to FIG. 2, there is shown a cross-sectional top view of the locking assembly taken along the lines 2—2 of FIG. 1.

The nut and bolt arrangements 28 and 29 are disposed such that they pass through barrel member 23 in grooves 50 and 51 as well as through door 11. Thus, barrel member 23 is mounted on door 11. Because of the configuration of barrel member 23, access to the outer end of the nut and bolt arrangement is minimized wherein removal thereof from the outside is largely prevented. In addition the use of carriage bolts or the like would further discourage or prevent removal of the locking assembly from outside.

FIG. 2 further shows in more detail the inner end of bolt 20. Thus, an elongated member 40 is attached to bolt 20, per se, by any known means. In fact, element 40 may be formed integrally from a stock material from which bolt 20 is fabricated. Element 40 is connected to end portion 43. An arcuate portion 42 is provided whereby end portion 43 may be more readily contoured to the configuration shown. In addition, arcuate portion 42 adds structural strength to member 40. Furthermore, this arcuate portion configuration permits shackle 22 of lock 30 a better purchase on the inner end of bolt 20.

Member 40 includes an aperture 41 therein. Aperture 41 is disposed to be aligned with aperture 25 in barrel element 23 when bolt 20 is in the home or locked position. Thus, shackle 22 of padlock 30 passes through apertures 24 and 25 as noted above. In addition, shackle 22 passes around member 43, arcuate portion 42 and through aperture 41 in the bolt portion. Consequently, when padlock 30 is in the position shown, bolt 20 is locked into aperture 31 whereby door 11 is locked and immovable relative to frame 10.

Figure 3:
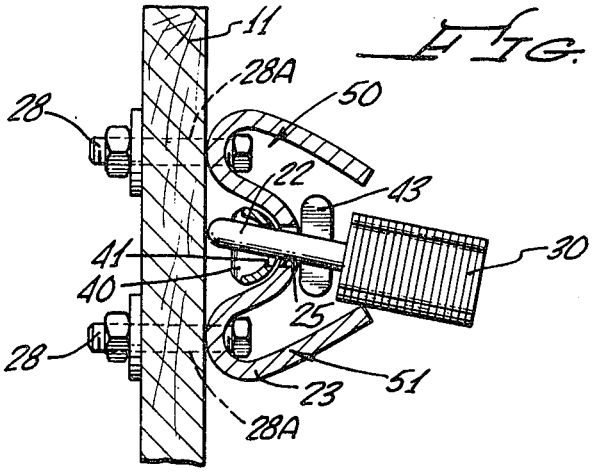
FIG. 3 is a cross-sectional view of the locking assembly taken along the lines 3—3 of FIG. 2.

Referring now to FIG. 3, there is shown a cross-sectional view of the locking assembly of the instant invention. This view is taken along lines 3—3 of FIG. 2. As is evident in FIG. 3, the nut and bolt assembly 28 passes through apertures 28A in grooves 50 and 51 of barrel member 23. By means of nut and bolt assemblies 28 barrel member 23 is secured to door 11. Bolt member 40 is slidably arranged in the central portion of barrel member 23. End 43 of the bolt member protrudes beyond the edges of the appropriate aperture in the central portion of barrel member 23. Shackle 22 of padlock 30 passes through aperture 25 in barrel member 23 and aperture 41 in bolt member 40. Shackle 22 also passes around end portion 43 and through aperture 24 (see FIG. 2) thereby locking bolt member 40 in the locked position.

Figure 4:
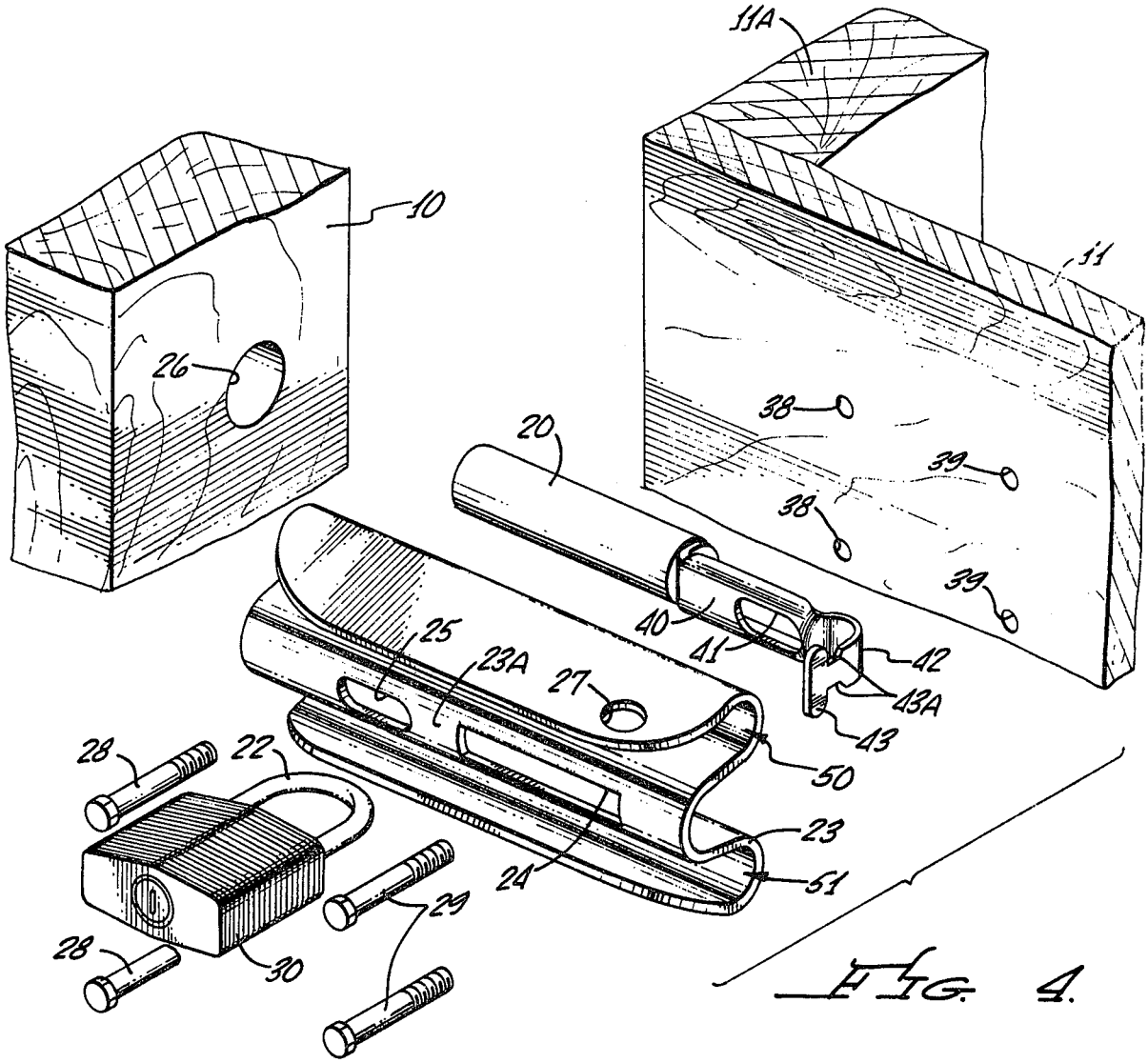
FIG. 4 is an exploded view of the locking assembly.

Referring now to FIG. 4, there is shown an exploded view of the locking apparatus described above. In particular, nut and bolt assemblies 28 and 29 pass through the respective apertures (shown best in FIG. 3) in grooves 50 and 51 of barrel portion 23. The nut and bolt assemblies pass through respective holes or apertures 38 and 39 in door 11 whereby barrel member 23 is secured to the door.

Prior to securing barrel member 23 to door 11, end portion 43 of bolt member 40 is inserted into slot 24 by turning bolt member 40 sideways and inserting end member 43 into slot 24 in the narrow direction. Bolt member 40 is then turned to the horizontal position as shown in FIG. 4. In this position, the ears of end portion 43 protrude beyond the edges of aperture 24 while notches 43A essentially define channels for the edges of aperture 24. Thus, when barrel member 23 is secured to door 11, bolt 20 is slidably secured in the central portion of barrel member 23. In the unlocked position, padlock 30 may be secured to barrel member 23 by inserting shackle 22 into aperture 27. In addition, bolt member 20 is moved, in this embodiment, toward the right by means of end portion 43. In this position, bolt 20 is displaced from aperture 26 in frame 10. In order to provide a locking arrangement, end portion 43 is moved towards the left, in this embodiment, wherein bolt 20 engages aperture 26 in frame 10. Shackle 22 of padlock 30 is then inserted into aperture 24, around end portion 43 and curved portion 42, through aperture 41 in bolt member 40, through aperture 25 and inserted into padlock 30 in the normal manner. Thus, access to end member 43 is prevented. Likewise, as best seen in FIG. 3, access to shackle 22 is substantially prevented.

Thus, there has been shown and described a preferred embodiment of the invention. It is understood that this description is illustrative of the invention and is not limitative thereof. It should be understood that those skilled in the art may contemplate other modifications to the invention. For example bolt 20 may be of any suitable shape such as cylindrical as shown. Likewise, barrel element 23 may be modified in terms of configuration. In addition, while the preferred embodiment shows and describes the bolt and barrel members as fabricated of heavy gage steel or the like, other suitable material may be utilized as well. However, modifications which fall within the purview of the instant description are intended to be included as well. The scope of the invention is determined only by the scope of the appended claims.

Having thus described a preferred embodiment invention, what is claimed is:

1. A locking assembly comprising:

a bolt member;

a barrel member, said barrel member including a central portion thereof for slidably mounting and enclosing said bolt member, said barrel member further including outer edge portions reversed upon themselves to form grooves for receiving means for mounting said barrel member of said locking assembly;

each of said barrel member and said bolt member having at least one aperture therein such that the apertures can be selectively aligned whereby a lock member can be inserted therethrough internally of said barrel member, said outer edge portions of said barrel member being reversed upon themselves by approximately 180° for a substantial distance such that the outer edges extend above said barrel member whereby said grooves are formed so as to protect said means for mounting and prevent access thereto.

2. The locking assembly recited in claim 1 wherein:

said bolt member includes a first portion thereof which is solid and a second portion thereof which engages said barrel member.

3. The locking assembly recited in claim 2 wherein:

said central portion of said barrel member includes apertures through which said second portion of said bolt member projects and through which the shackle portion of a lock member extends.

4. The locking assembly recited in claim 2 wherein:

said first portion of said bolt member is substantially cylindrical in configuration; and said second portion of said bolt member includes a relatively thin member having an arcuate portion at the end thereof whereby the end of said second portion of said bolt member protrudes through said central portion of said barrel member.

5. The locking assembly recited in claim 4 wherein:

said end of said second portion of said bolt member includes ear-like extensions for retaining said bolt member in said barrel member.

6. The locking assembly recited in claim 1, wherein said barrel member receives the shackle of a lock member through said aperture and within said barrel member.

7. The locking assembly recited in claim 1 wherein; said barrel member is formed of a unitary blank rolled into a double S configuration.

* * * * *